US005251898A

United States Patent [19]

Dickenson et al.

[11] Patent Number: 5,251,898

[45] Date of Patent: Oct. 12, 1993

[54] GAMING APPARATUS WITH BI-DIRECTIONAL REELS

[75] Inventors: Robert M. Dickenson; Raymond Heidel, both of Henderson, Nev.

[73] Assignee: Bally Gaming International, Inc., Las Vegas, Nev.

[21] Appl. No.: 749,845

[22] Filed: Aug. 26, 1991

[51] Int. Cl.[5] ..... A63F 5/04

[52] U.S. Cl. ..... 273/143 R

[58] Field of Search ..... 273/142 R, 142 B, 142 H, 273/142 HA, 143 R, 138 A

[56] References Cited

U.S. PATENT DOCUMENTS

| | | | |
|---|---|---|---|
| 689,365 | 12/1901 | McMullen | 273/143 R |
| 4,448,419 | 5/1984 | Telanes | 273/143 R |
| 4,648,600 | 3/1987 | Olliges | 273/138 A |
| 4,711,451 | 12/1987 | Pajak | 273/143 R |
| 4,858,932 | 8/1989 | Keane | 273/143 R |

*Primary Examiner*—William H. Grieb
*Attorney, Agent, or Firm*—Jenner & Block

[57] ABSTRACT

A gaming apparatus with bi-directional, rotatable symbol bearing reels is disclosed. The gaming apparatus includes a microprocessor which generates a direction signal to control the rotation of each of the reels via a reel control mechanism. The reel control mechanism employs stepper motors or the like to rotate each of the reels in either a clockwise or counterclockwise direction about an axis, depending on value of the direction signal. In some cases, the microprocessor generates the direction signal in accordance with a random event so that the reels rotate randomly in different directions.

14 Claims, 3 Drawing Sheets

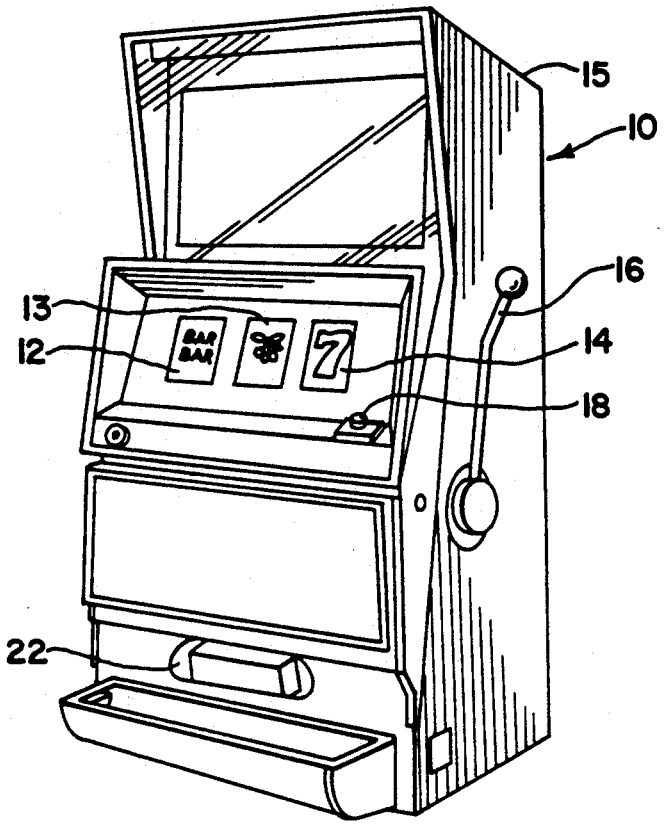
Fig. 1
Fig. 2
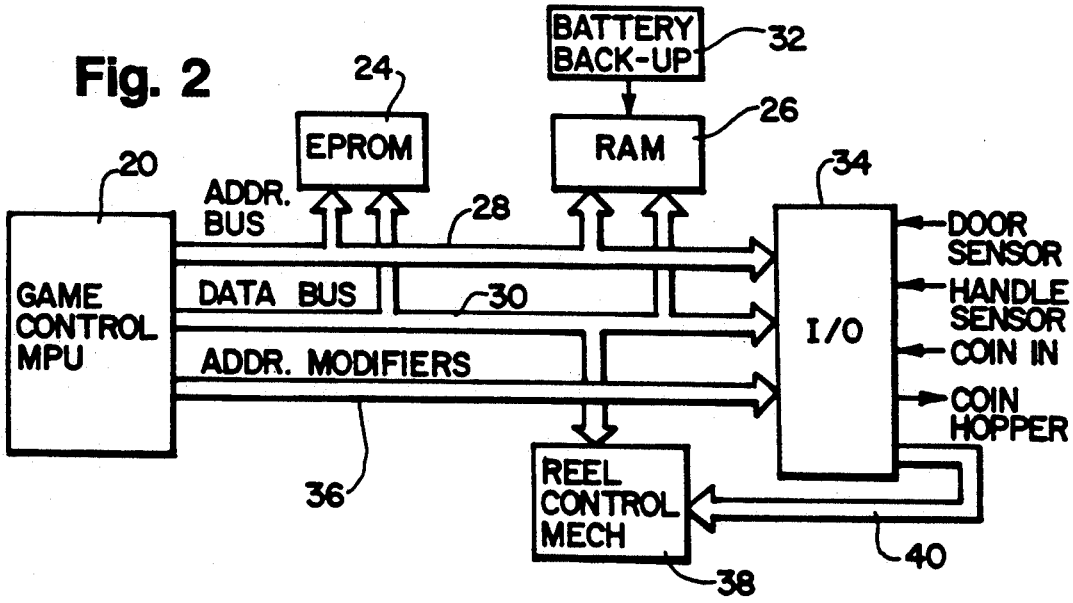

GAMING APPARATUS WITH BI-DIRECTIONAL REELS

FIELD OF THE INVENTION

The invention relates to the field of gaming devices, and more particularly to gaming devices having rotating reels.

BACKGROUND OF THE INVENTION

Gaming devices are known which include a number of rotating, symbol bearing reels each of which is individually stopped to display a randomly selected symbol along a win line. If the symbols displayed along the win line form a winning combination, a prize is paid out to the player. Typically, the reels are rotated by a stepper motor or like device, which is controlled by a microprocessor. A characteristic of current reel spinning machines is that the reels normally all spin in the same direction. In the gaming machine industry it is considered desirable to add features which increase player interest and enjoyment.

SUMMARY OF THE INVENTION

It is therefore an object of the invention to provide a reel type gaming apparatus having a plurality of symbol bearing reels wherein the direction of spin of each reel is independently controlled. Additionally the direction of spin for each reel is governed by a random event so that each reel spins in a different direction for each game play. In some cases, the random event is the value of a random number. In other cases, the gaming machine includes a video display on which the reels are displayed.

In another embodiment of the invention, a gaming apparatus is provided which includes a first motor means for rotating at least one of the reels in a first direction, and a second motor means for rotating at least one of the reels in a second direction. Selection logic engages at least one of the reels with the first motor, and at least one of the other reels with the second motor.

In another embodiment a reel-type gaming apparatus is provided having a circuit for generating a plurality of signals which indicate direction. Each of the signals corresponds to one or more of the reels. A motor is responsive to the signals for rotating each of the reels in the direction indicated by its corresponding signal. In some cases, the circuit generates each of the direction signals according to the outcome of a random event. In other cases the random event is the value of a random number.

In yet another embodiment, a reel-type gaming apparatus is provided, which includes a circuit for generating a random binary signal. The binary signal contains a set of bits. Each of the bits corresponds to at least one of the reels. A motor is responsive to the binary signal, and rotates each of the reels in a first direction if the reel's corresponding bit has a first value. The motor rotates the reel in a second direction if the reel's corresponding bit has a second value. In some cases, the first direction is clockwise, the second direction is counterclockwise, the first bit value is low, and the second bit value is high.

In accordance with yet another embodiment, a reel-type gaming apparatus is provided having a circuit for randomly generating a group of binary signals. Each of the signals comprises a set of bits, and each of the bits corresponds to at least one of the reels. A selection circuit selects one of the binary signals which has bits that are not all equal. If none of the binary signals have bits that are not all equal, the selection circuit selects one of the binary signals. Connected to each reel is a motor which is responsive to the selection circuit for rotating each of the reels in a first direction if its corresponding bit in the selected binary signal has a first predetermined logic level. The motor rotates the reel in a second direction if its corresponding bit has a second predetermined logic level.

It is another object of the invention to provide a method for rotating the reels of a reel-type gaming apparatus. In this method, a first group of binary signals is generated. Each of the reels is assigned to a bit in the first group of binary signals. Each of the reels is then rotated in the first direction if its assigned bit is at a first logic level, and in a second direction if its assigned bit is at a second logic level. Preferably the binary signals are randomly generated. In another feature, after the first group of binary signals is generated, the bits are compared. If each of the bits are equal, a second group of binary signals is generated and the first group of binary signals is replaced by the second group of binary signals.

BRIEF DESCRIPTION OF THE DRAWINGS

FIG. 1 is a perspective view of a reel-type gaming apparatus employing the invention;

FIG. 2 is a block diagram of the electronic control circuit used by the gaming apparatus illustrated in FIG. 1;

DETAILED DESCRIPTION OF THE INVENTION

Figure 3:
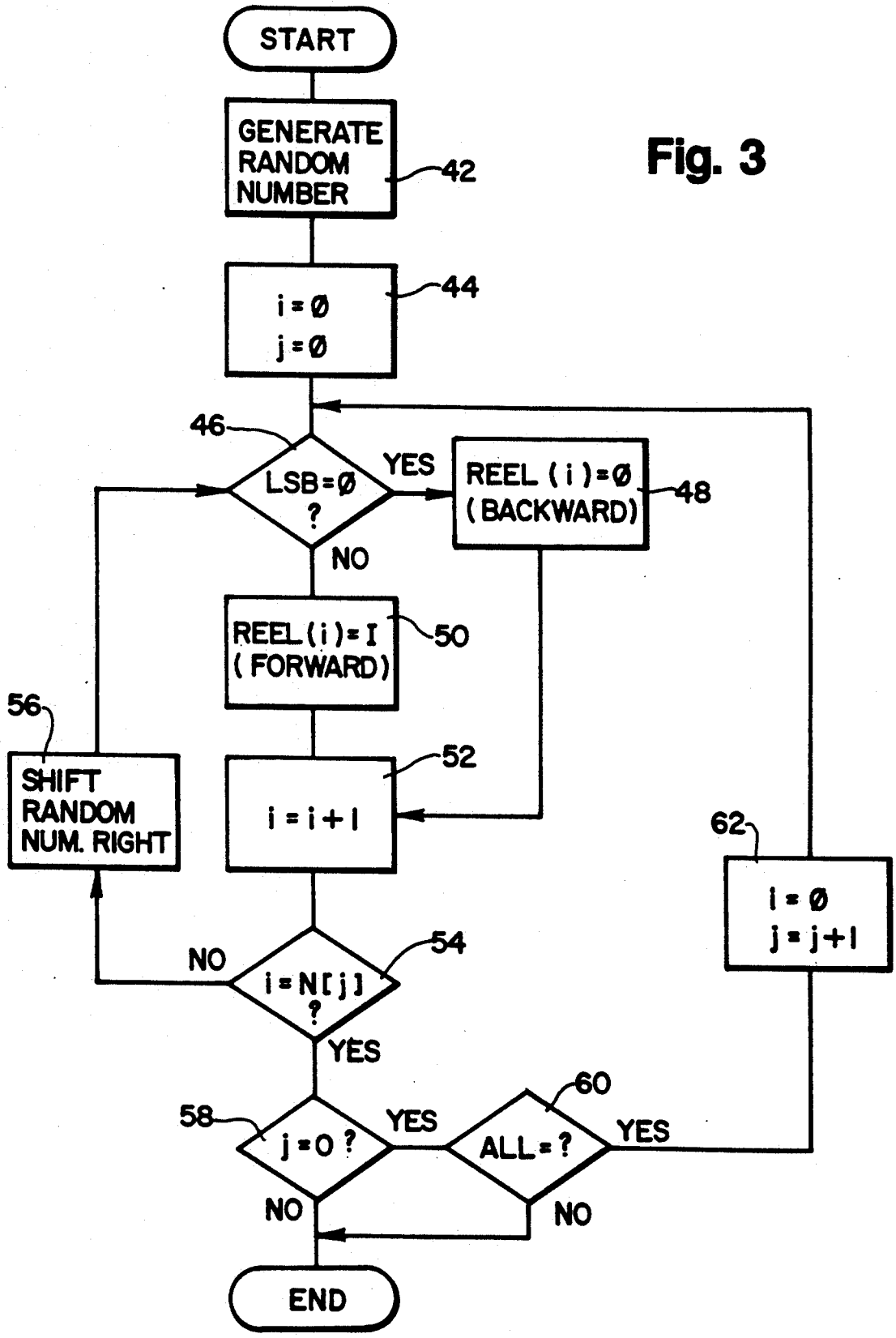
FIG. 3 is a flow chart illustrating a reel direction control routine performed by the electronic control circuit illustrated in FIG. 2.

A gaming apparatus 10 employing the embodiment of the invention is shown in FIG. 1. The gaming apparatus 10 includes three symbol bearing reels 12, 13 and 14 within a housing 15, which are caused to rotate in response to a player actuated handle 16 after a coin is inserted into a coin input slot 18. In lieu of physical reels, gaming apparatus 10 may display reels 12, 13 and 14 on a video display or like device.

The gaming apparatus 10 includes a game control microprocessor 20, as shown in FIG. 2, which rotates and stops each of the reels 12 through 14 to display three randomly selected symbols along win lines. If the symbols displayed along the win lines form a wining combination, the microprocessor 20 causes the coin hopper (not shown) to pay out through a payout chute 22 a number of coins or tokens.

The game control microprocessor 20, shown in FIG. 2, is preferably a Motorola 68000 processor. The processor 20 controls the operation of the gaming apparatus 10 in accordance with programs and data stored in EPROM 24 and a RAM 26. The EPROM 24 and RAM 26 are coupled to the processor 20 by an address bus 28 and a data bus 30. To ensure that no data stored in the RAM 26 is lost during a power failure, the RAM 26 is coupled to a battery back-up circuit 32. The game control microprocessor 20 is also coupled to various input sensors and apparatus as well the coin hopper through an input/output board 34 which is coupled to the processor 20 through the address and data buses 28 and 30, and an address modifier line 36. In order to address the input/output board 34, the game control processor 20 must output the correct address modifiers for the input-/output board 34 on line 36 as well as the address for the input/output board 34 on the address bus 28.

The game control microprocessor 20 controls each of the reels 12 through 14 through a reel control mechanism 38 which is coupled to the data bus 30. The reel control mechanism 38 incudes a stepper motor or the like for each of the reels 12 through 14 to start and stop the rotation the of the reels in accordance with the data on bus 40 from the game control microprocessor 20. The reel control mechanism is also coupled to the input-/output board 34 which is responsive to the microprocessor 20 for selecting a particular one of the stepper motor controls to receive data from the bus 40.

Each of the stepper motors is bi-directional, and can rotate its associated reel 12 through 14 in either a clockwise or counterclockwise direction, depending on the data which is received from game control microprocessor 20. For example, microprocessor 20 can rotate the reel 12 by selecting the stepper motor associated with the reel 12, and generating a direction control signal or bit on the data bus 40. Logic circuits (not shown) associated with the reel control mechanism 38 cause the stepper motor to turn clockwise in response to a first direction control signal, and counterclockwise in response to a second direction control signal. Thus, the reel 12 is turned clockwise or counterclockwise in accordance with the value of the direction control signal which the microprocessor 20 places on the data bus 30. In the preferred embodiment, the first value is a zero, and the second value is a one, or vice versa. Of course, the conventions adopted here are arbitrary. For example, the first value can be any number or range of numbers, such as numbers less than zero.

In accordance with the invention, microprocessor 20 causes each of the reels 12 through 14 to rotate independently in either a clockwise or counterclockwise direction. A variety of techniques may be used to select the direction of rotation of each reel 12–14 including the reel stop position selected by the microprocessor 20 prior to each handle pull or other predetermined direction criteria. Preferably, the direction in which the microprocessor 20 rotates each of the reels 12 through 14 is determined by a random number, which microprocessor 20 generates each time the handle 16 is pulled. This random number can be a byte with 8 bits. Each of the first three least significant bits is assigned to one of the three reels 12 through 14. If all three bits are the same, then the next three least significant bits are assigned to the reels 12 through 14. The rationale for substituting the first three bits with the next three bits is that it is desirable to have at least one of the three reels turning in a different direction from the other two. Therefore, if the first three bits fail to produce this result, the microprocessor 20 tries the next three bits. Theoretically, this process could be repeated indefinitely. However, because the random number contains only a finite number of bits, the process is only repeated twice.

FIG. 3 illustrates a logic flow chart of a reel control software routine which implements the above-described functions. Referring to FIG. 3, at a block 42, a random number is generated by the game control microprocessor 20. Programming techniques for generating random numbers are widely known. Preferably, the random number is a one-byte number which comprises eight individual bits. At the block 44, index variables i and j are set to zero. The variable i is an index to a REEL array. Each element of the three-element REEL array corresponds to one of the reels 12 through 14. The variable j is an index to the two-element N array, which contains predetermined upper limits, as discussed below.

At a decision block 46, the least significant bit ("LSB") of the random number generated in the block 42 is examined. If the LSB is equal to zero, control moves to the block 48. Otherwise, control continues to the block 50. At the block 48, the $i^{th}$ element of the REEL array is set equal to zero. Control then continues on to the block 52. At the block 50, the $i^{th}$ element of the REEL array is set equal to one. As discussed above, the value 0 corresponds to clockwise reel rotation, and the value one corresponds to counterclockwise reel rotation.

Control then moves from the block 48 or the block 50, as the case may be, to a block 52. At the block 52, the variable i is incremented by one. Control then moves to a decision block 54, where the variable i is compared to the first predetermined upper limit, $N_0$. It will be observed that j is equal to zero during this first iteration. Therefore, $N_j$ is also expressed as $N_0$. Preferably, $N_0$ is equal to the number of physical reels. In gaming machine 10, there are three physical reels 12 through 14. Therefore, $N_0$ is set to 3. In other embodiments, there may be five reels, and, accordingly, $N_0$ is set to five. If i is not equal to $N_0$, then control moves to a block 56. At the block 56, the random number generated at the block 42 is shifted right by one bit. Control then returns to the block 46, and the blocks 46 through 54 are repeated. In practice, the random number generated at the block 42 has a total number of bits (preferably 8) which exceeds $N_0$, the number of reels. The second predetermined constant $N_1$ is equal to the lesser of $N_0$ or the number of extra bits (i.e., the total number of bits minus $N_0$). For example, if the random number is 8 bits, and there are three reels, $N_1$ is equal to 3.

If i is equal to Ne at the decision block 54, then control continues to a decision block 58. It should be noted that as the foregoing blocks 46 through 56 are repeated, the variable i is incremented by one during each iteration. Thus, after $N_0$ iterations, i will be equal to $N_0$. The effect of the foregoing processing is to assign the value of the first $N_0$ bits of the random number to the first $N_0$ elements of the REEL array. As discussed above, each element of the REEL array corresponds to the direction of one of the physical reels 12 through 14.

At the decision block 60, the values of the elements of the REEL array are compared. If the values are not all equal, processing successfully terminates. If the values are all equal, then a second attempt is made to assign values which are not all the same. This second attempt begins at the block 62, where the variable i is reset to zero and the variable j is incremented. Control then returns to the block 46, where a second iteration of the blocks 46 through 58 begins. During this second iteration, j is equal to one, and therefore the blocks 46 through 58 are repeated $N_1$ times. Thus, the next $N_1$ bits of the random number are assigned to the first $N_1$ elements of the REEL array. It will be observed that depending on the size of the REEL array and the random number, $N_1$ may be less than the total number of elements in the REEL array.

This second attempt is made in an effort to have at least one element of the REEL array with a value which is different from the other elements. There is no guarantee that this second attempt will achieve this objective, and in theory the process could be repeated indefinitely until the objective is met. In practice, however, the random number has only a fixed number of bits. Therefore, only two attempts are made. To this end, at a decision block 58, if the value of j is greater than zero, processing terminates. Otherwise, control continues to the block 60, as discussed above. It will be observed that the variable j is incremented after the first attempt. In this manner, processing terminates after the second attempt because at the block 60, the value of j will be greater than zero.

Figure 4:
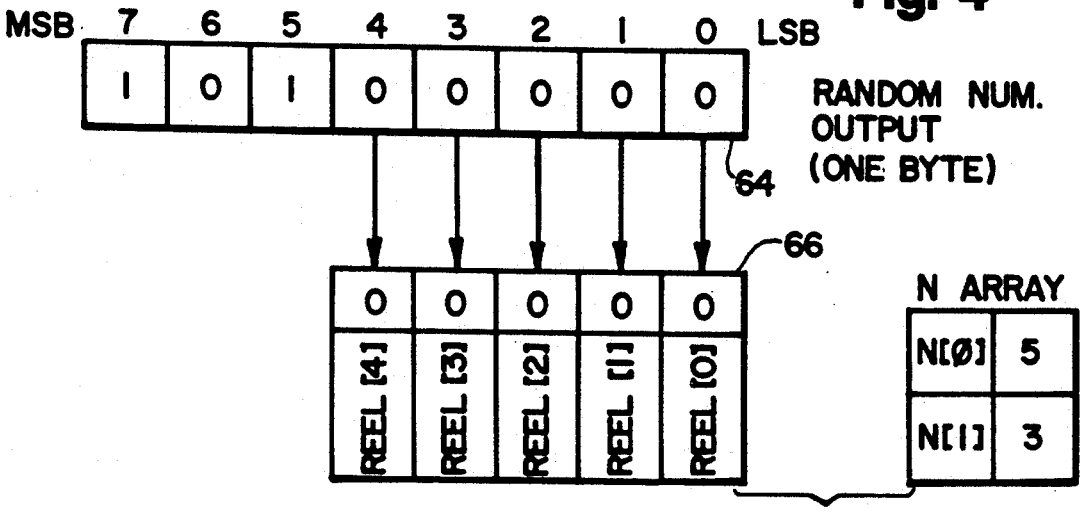
FIG. 4 is a block diagram of memory locations in the electronic control apparatus a second reel-type gaming apparatus.

The foregoing process may be better understood by reference to the block diagram in FIG. 4. FIG. 4 depicts a random number 64 as generated by a microprocessor used in a second gaming apparatus. This second gaming apparatus is identical to gaming apparatus 10 except it has five reels instead of three. This second apparatus employs the reel direction control routine illustrated in FIG. 3. The random number 64 comprises a plurality of bits (in this case eight) designated zero through seven. Bit zero is the least significant bit ("LSB"). A REEL array 66 is also shown. The REEL array 66 comprises five elements REEL[0] through REEL[4], each of which corresponds to one of five physical reels. Accordingly, an N array 67 comprises $N_0$ (which is equal to 5, the number of REEL array elements) and $N_1$ (which is equal to 3, the number of remaining bits after the first five bits are assigned). During the performance of the blocks 46 through 54, the five least significant bits of the random number 66 are successively assigned to their corresponding elements in the REEL array 66, as indicated by arrows in FIG. 4.

For illustration purposes, all of the values assigned to the REEL array 66 are shown as equal to zero. Consequently, a second iteration of the blocks 46 through 54 is made, during which the remaining three bits of the random number 64 are assigned to the first three elements of the REEL array 66.

Figure 5:
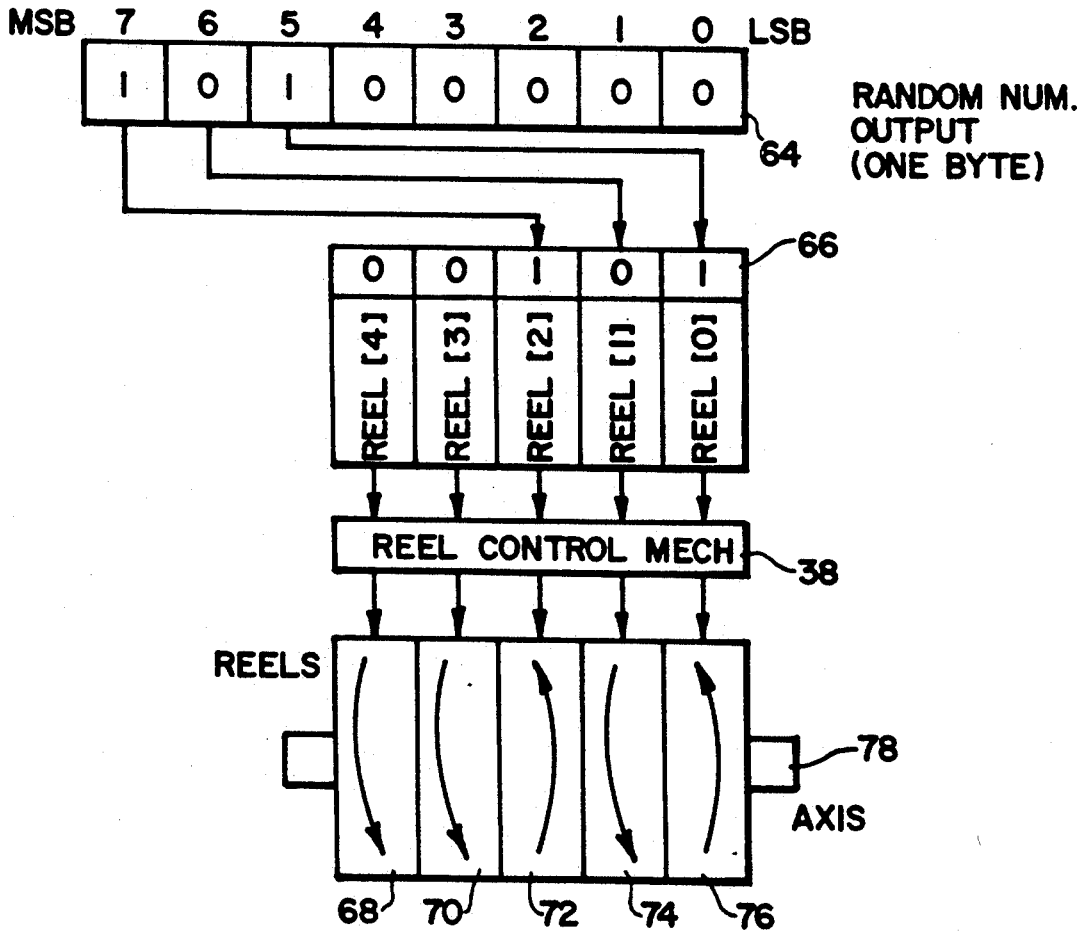
FIG. 5 is a block diagram of a second reel-type gaming apparatus employing the invention.

FIG. 5 depicts the contents of the REEL array 66 after this second iteration. After the second iteration, the bits of random number 64 are exhausted, and no additional iterations are performed. In any event, the contents of the REEL array 66 happen to contain at least one value that is different from the rest, thereby fulfilling the objective of having the reels spin randomly in different directions.

For clarity, FIG. 5 shows the reel control mechanism 38, which in the depicted embodiment controls each of five reels 68 through 76 by a stepper motor or like device. Each of the elements of the REEL array 66 corresponds to one of the five stepper motors. As microprocessor 20 successively selects each stepper motor, it places the element of the REEL array corresponding to the stepper motor onto the data bus 30. Logic in the reel control mechanism 38 causes each motor to turn its associated reel clockwise around the axis 78 if its corresponding element is a zero, and counterclockwise if its corresponding element is a one. Arrows on each of the reels 68 through 76 indicate its movement relative to the axis 78 in response to the corresponding element of the REEL array 66.

We claim:

1. A gaming apparatus, comprising:

a plurality or rotatable, symbol bearing reels;

means for generating a random event; and means for selectively and independently rotating each of said reels in a clockwise or a counterclockwise direction in accordance with the outcome of said random event.

2. A gaming apparatus according to claim 1, wherein said random event is the value of a random number generated prior to game play.

3. A gaming apparatus having a plurality of symbol bearing reels mounted for rotation about an axis comprising:

first rotation means for rotating at least one of the reels in a first direction;

second rotation means for rotating at least one of the reels in a second direction; and selection means for randomly selectively engaging at least one of the reels with said first rotation means, and engaging at least one other of the reels with said second rotation means.

4. A gaming apparatus having a plurality of symbol bearing reels mounted for rotation about an axis comprising:

generation means for generating a plurality of signals which indicate direction, one of each of said signals corresponding to at least one of the reels; and rotation means responsive to said signals for rotating each of the reels in the direction indicated by that one of said signals corresponding to the reel.

5. The gaming apparatus according to claim 4 wherein said generation means generates each of said signals according to the outcome of a random event.

6. The gaming apparatus according to claim 5 wherein said random event is the value of a random number.

7. A gaming apparatus having a plurality of symbol bearing reels mounted for rotation about an axis comprising:

means for generating a random binary signal having a plurality of bits, wherein each one of said bits corresponds to one of the reels; and rotation means responsive to said binary signal for rotating each of the reels in a first direction in response to the reel's corresponding bit having a first value, and in a second direction in response to said corresponding bit having a second value.

8. The apparatus according to claim 7 wherein said first direction is clockwise, said second direction is counterclockwise, said first bit value is low, and said second bit value is high.

9. A gaming apparatus having a plurality of symbol bearing reels mounted for rotation about an axis, comprising:

means for randomly generating a plurality of binary signals, each of said binary signals comprising a plurality of bits, each of said bits corresponding to one of the reels;

selection means for selecting one of said plurality of binary signals which has bits that are not all equal, and for selecting a predetermined one of said plurality of binary signals if all of said binary signals have bits that are all equal; and motor means responsive to said selection means for rotating each of the reels in a first direction in response to the corresponding bit in said selected binary signal having a first predetermined logic level, and in a second direction in response to the corresponding bit in said selected binary signal having a second predetermined logic level.

10. In a gaming apparatus with symbol bearing rotatable reels mounted on an axis for rotation, a method for rotating the reels, comprising the steps of:

(a) generating a first plurality of binary signals;

(b) assigning each of the reels to one of the first plurality of binary signals; and (c) rotating each of the reels in a first direction if its assigned binary signal is at a first predetermined logic level, and in a second direction if its assigned binary signal is in a second predetermined logic level.

11. The method according to claim 10 wherein said first plurality of binary signals is randomly generated.

12. The method according to claim 10 wherein further comprising the following step, which are performed between steps (a) and (b):

comparing each of the first plurality of binary signals; and if each of the first plurality of binary signals are equal, generating a second plurality of N binary signals, and replacing up to N binary signals of said first plurality with said second plurality of binary signals.

13. A gaming apparatus, comprising:

means for generating a random event;

reel display means for displaying a plurality of rotating sets of symbols; and control means for selectively and independently rotating each of said rotating sets in a clockwise or a counterclockwise direction in accordance with said predetermined random event.

14. The gaming apparatus of claim 13, wherein said reel display means includes a plurality of rotatable reels, each reel bearing one of said plurality of sets of symbols.

* * * * *